US012385346B2

(12) United States Patent
Fairweather

(10) Patent No.: US 12,385,346 B2
(45) Date of Patent: Aug. 12, 2025

(54) METHOD AND APPARATUS FOR CUTTING AND PULLING CUT SECTION OF TUBING IN AN OPEN HOLE SECTION OF A WELLBORE

(71) Applicant: Ardyne Holdings Limited, Aberdeen (GB)

(72) Inventor: Alan Fairweather, Aberdeen (GB)

(73) Assignee: ARDYNE HOLDINGS, LIMITED, Aberdeen (GB)

( * ) Notice: Subject to any disclaimer, the term of this patent is extended or adjusted under 35 U.S.C. 154(b) by 14 days.

(21) Appl. No.: 17/800,252

(22) PCT Filed: Mar. 4, 2021

(86) PCT No.: PCT/EP2021/055468
§ 371 (c)(1),
(2) Date: Aug. 17, 2022

(87) PCT Pub. No.: WO2021/175995
PCT Pub. Date: Sep. 10, 2021

(65) Prior Publication Data

US 2023/0061851 A1 Mar. 2, 2023

(30) Foreign Application Priority Data

Mar. 5, 2020 (GB) ..... 2003163

(51) Int. Cl.
*E21B 29/00* (2006.01)
*E21B 23/06* (2006.01)
(Continued)

(52) U.S. Cl.
CPC ..... *E21B 31/20* (2013.01); *E21B 23/06* (2013.01); *E21B 29/002* (2013.01); *E21B 31/16* (2013.01);
(Continued)

(58) Field of Classification Search
CPC ..... E21B 31/12; E21B 31/16; E21B 31/18; E21B 31/20; E21B 33/127–1277; E21B 29/00–005; E21B 23/01
See application file for complete search history.

(56) References Cited

U.S. PATENT DOCUMENTS 3,085,627 A * 4/1963 Sodich ..... E21B 33/1208 166/212
5,242,019 A * 9/1993 Benker ..... E21B 33/1208 166/212
(Continued)

FOREIGN PATENT DOCUMENTS

CA 2467571 C 11/2004
CN 106812494 A 12/2015
(Continued)

OTHER PUBLICATIONS

European Patent Office as International Search Authority; International Search Report and Written Opinion for PCT/EP2021/055468; Jun. 8, 2021; all pages; European Patent Office, Rijswijk, The Netherlands.
(Continued)

*Primary Examiner* — Blake Michener
(74) *Attorney, Agent, or Firm* — LAW OFFICE OF JESSE D. LAMBERT, LLC

(57) ABSTRACT

A method and apparatus to move an object in an open hole section of a wellbore. A bottom hole assembly including a downhole pulling tool and fishing device is described. The downhole pulling tool includes an open hole anchor to allow location of the downhole pulling tool in the open hole section of the wellbore so as to reduce the operating distance between the downhole pulling tool and the fishing device. An embodiment in which a cut section of tubular is removed from the open hole section is described. A casing cutter may
(Continued)

also be located in the bottom hole assembly to cut the tubular on the same trip in the well as removing the cut section of tubular.

10 Claims, 4 Drawing Sheets

(51) Int. Cl.

| | |
|---|---|
| ***E21B 31/16*** | (2006.01) |
| ***E21B 31/20*** | (2006.01) |
| ***E21B 33/127*** | (2006.01) |
| ***E21B 33/129*** | (2006.01) |
| ***E21B 37/00*** | (2006.01) |
| *E21B 34/14* | (2006.01) |

(52) U.S. Cl.
CPC ..... *E21B 33/127* (2013.01); *E21B 33/1293* (2013.01); *E21B 37/00* (2013.01); *E21B 34/14* (2013.01)

(56) References Cited

U.S. PATENT DOCUMENTS

| | | | | |
|---|---|---|---|---|
| 5,417,289 | A * | 5/1995 | Carisella | E21B 33/1277 166/123 |
| 6,491,104 | B1 | 12/2002 | Willie et al. | |
| 8,365,826 | B2 | 2/2013 | Braddick | |
| 10,392,901 | B2 | 8/2019 | Evertsen | |
| 10,458,196 | B2 | 10/2019 | Schultz, Jr. et al. | |
| 10,781,653 | B2 | 9/2020 | Sunde et al. | |
| 10,907,432 | B2 | 2/2021 | Evertsen | |
| 2015/0300154 | A1* | 10/2015 | Hallundbæk | E21B 47/117 166/250.17 |
| 2019/0048677 | A1* | 2/2019 | Evertsen | E21B 31/20 |
| 2019/0257168 | A1* | 8/2019 | Sunde | E21B 29/002 |

FOREIGN PATENT DOCUMENTS

| | | | |
|---|---|---|---|
| GB | 2423779 | A | 9/2006 |
| GB | 2556461 | A | 5/2018 |
| GB | 2562088 | A | 11/2018 |
| GB | 2562089 | A | 11/2018 |
| GB | 2568815 | A | 5/2019 |
| GB | 2574647 | A | 12/2019 |
| GB | 2576010 | A | 2/2020 |
| RU | 2708740 | C1 | 12/2019 |
| WO | WO 2015/065196 | A1 | 5/2015 |
| WO | WO 2017/046613 | A1 | 3/2017 |
| WO | WO 2017/182549 | A1 | 10/2017 |
| WO | WO 2019/211602 | A1 | 11/2019 |

OTHER PUBLICATIONS

Intellectual Property Office of the UK Patent Office; Search Report for GB2003163.9; Sep. 3, 2020; all pages; Intellectual Property Office of the UK Patent Office, Newport, United Kingdom.

* cited by examiner

METHOD AND APPARATUS FOR CUTTING AND PULLING CUT SECTION OF TUBING IN AN OPEN HOLE SECTION OF A WELLBORE

The present invention relates to methods and apparatus for wellbore operations such as fishing, re-completion and abandonment and in particular, though not exclusively, to a method and apparatus for tubing recovery.

In the course of constructing an oil or gas well, a hole is drilled to a pre-determined depth. The drilling string is then removed and a metal tubular or casing is run into the well and is secured in position using cement. This process of drilling, running casing and cementing is repeated with successively smaller drilled holes and casing sizes until the well reaches its target depth. At this point, a final tubular or tubing is run into the well referred to as a completion. The well is produced through the tubing.

In many deviated wells, and particularly in horizontal wells, the target depth represents the build section and the well is then drilled over the horizontal section. This lower section may be referred to as 'open hole' as it is too expensive and technically difficult to cement casing or other tubulars here. Thus, outer casing is run and cemented to a casing shoe located at the end of the build section where the well then has a horizontal section. The well is completed by running an inner tubular string into the deviated or horizontal open hole section of the well. The inner tubular string is typically held in place with packers which seal the annulus between the tubular string and the borehole wall. The inner tubular string may include frac sleeves and the like to access the formation in the open hole section.

When production becomes uneconomical in these wells, but there is still recoverable hydrocarbons present in the reservoir, the well can be re-completed. The lower completion in the open hole is removed and replaced. To remove the inner tubular string, it is cut and pulled in sections. The cutting and pulling of tubulars is a known technique in well abandonment. A cutting tool is run into the tubular string and cuts a section of tubing. The cut section of tubing is then gripped by a spear and pulled to surface. The spear can be considered as a pulling tool. Each trip into a well takes substantial time and consequently significant costs. Combined casing cutting and pulling tools have been developed so that the cutting and pulling can be achieved on a single trip. Such a tool is the TRIDENT® System to Ardyne Technologies Limited, UK.

WO2017046613 describes a cutting and pulling tool which advantageously has a cutting tool which can be operated by rotation of the work string while the pulling tool is anchored to the inside wall of the casing section above the cut to hold the casing in tension and provide stability to the cutting action. The pulling tool may be considered as an anchor or spear.

The casing is cut and pulled in sections to a desired depth and if one can pull long lengths of cut casing from the well this further reduces the number of trips required to achieve casing recovery. However, it is known that the presence of drilling fluid sediments, partial cement, sand, or other settled solids in the annulus between the outside of the casing and the inside of a surrounding outer casing can act as a binding material limiting the ability to free the casing when pulled.

Traditionally, cut casing is pulled by anchoring a casing spear to its upper end and using an elevator/top drive on a drilling rig. However, some drilling rigs have limited pulling capacity, and a substantial amount of power is lost to friction in the drill string between the top drive and the casing spear, leaving insufficient power at the spear to recover the casing. Consequently, further trips must be made into the well to cut the casing into shorter lengths for multi-trip recovery.

To increase the pulling capability, a downhole power tool (DHPT) available from Ardyne Technologies Limited, UK, has been developed. After the casing has been located and engaged with a casing spear, hydraulically-set mechanically releasable slips anchor the DHPT to the wall of the larger outer casing above. A static pressure is applied to begin the upward movement of the cut casing, with the DHPT downhole multi-stage hydraulic actuator functioning as a hydraulic jack. After the stroke is completed, the anchors are released. The power section can be reset and the anchor re-engaged as many times as required. The DHPT is described in U.S. Pat. No. 8,365,826 to the present Applicants, the disclosure of which is incorporated herein in its entirety by reference.

The combination of a cutting and pulling tool with a hydraulic jack is provided in the TITAN® system available from Ardyne Technologies Ltd, UK. It is described in U.S. Pat. No. 10,781,653 to the present Applicants, the disclosure of which is incorporated herein in its entirety by reference.

For the removal of the tubing string in the open hole section of a well, a hydraulic jack is required as the tubular is fixed in place by the packers and other debris that has collected around the tubular string in the open hole. Typically, the downhole pulling tool is anchored to the outer cemented casing above the casing shoe and a fishing device in the form of a spear or overshot is connected to the upper end of the cut section of tubular in the open hole. The downhole pulling tool is then used to jack the cut section of tubular free to recover it.

However, as deeper sections of the inner tubular string are removed, the distance between the cut section of tubular and the outer casing can become significant. Applying the high forces at the downhole pulling tool to move a cut section of tubular results in the drill string between the tubular and the pulling tool to elongate. Sometimes the 'stretch' is so long that the stroke of the pulling tool is used up before sufficient force can be generated to release the cut section of tubular. Additionally, operating difficulties are found in pulling the drill string around the deviation or heel.

It is therefore an object of the present invention to provide a method to move an object in an open hole section of a wellbore which obviates or mitigates one or more disadvantages of the prior art.

It is a further object of the present invention to provide apparatus to move an object in an open hole section of a wellbore which obviates or mitigates at least one disadvantage of the prior art.

According to a first aspect of the present invention there is provided a method to move an object in an open hole section of a wellbore, comprising the steps:

(a) providing a downhole assembly on a work string, the downhole assembly including a downhole pulling tool and a fishing device;
(b) running the work string in the wellbore and the downhole assembly into the open hole section;
(c) gripping the object with the fishing device;
(d) anchoring the downhole assembly to a wall of the open hole section by contacting an elastomeric anchor element of the assembly to the wall of the open hole section;
(e) operating the downhole pulling tool to pull the object and thereby move the object;
(f) releasing the downhole assembly from the wall of the open hole section; and (g) raising the work string to remove the downhole assembly from the wellbore.

In this way, by anchoring the downhole pulling tool in the open hole section it can be close to the object so that the pulling force is directly applied to the object without elongating the drill string between the downhole pulling tool and the object. Preferably the steps are completed in order. More preferably the steps are completed on a single trip in the well. Preferably, in step (b), in running the work string in the wellbore and the downhole assembly into the open hole section, the downhole assembly will be run through cased section of the wellbore. More preferably, the cased section comprises casing cemented in place. The cased section may be considered as the upper completion and the open hole section as the lower completion.

Preferably at step (g) the object is removed from the wellbore on the work string. Preferably, the object is a cut section of tubular. In this way, the inner liner string can be removed for a well to be re-completed or abandoned. Alternatively, the object is a downhole component such as a valve. In this way, any part of the lower completion can be removed using the downhole assembly. The object may be an actuator. In this way, the actuator can be moved to operate a tool such as a valve in a downhole completion. This the method can be used in well procedures such as fishing, re-completion and abandonment.

Preferably, the elastomeric anchor element is a packer element and step (d) comprises inflating the packer element to contact the wall and step (f) comprises deflating the packer element to disengage from the wall of the open hole section. Additionally, step (d) may comprise engaging the wall with at least one gripping element of the downhole assembly and step (f) comprises releasing the gripping element from the wall of the open hole section. In this way, open hole packers can be used. Preferably the open hole packer is retrievable. More preferably, the open hole packer is resettable so that it may be set and unset multiple times on a single trip in the well. As no seal is required between the downhole assembly and the wall of the open hole section, an anchor can be used at step (d). Such an anchor would include the one or more gripping elements. The gripping element may be a slip in a slip assembly. More preferably, the gripping element provides sufficient friction or grip to hold the assembly in place while the packer is set.

Preferably, the downhole assembly is configured for a grip force in anchoring the assembly to the wall of the open hole section to be greater than a pull force of the assembly on the object. The downhole assembly may be operated hydraulically by pumping fluid through the work string from surface. The grip force of the packer used to anchor the assembly and the pull force of the downhole assembly are both proportional to the pressure applied. By configuring the assembly such that the packer grip force is always higher than the pull force, the downhole assembly cannot stroke before the packer gets enough grip to prevent the packer sliding down the hole as you stroke the assembly, instead of the object moving up hole.

Preferably, the method includes an additional step of jetting fluid from the downhole assembly to wash the wall of the open hole section against which the downhole assembly will be anchored. In this way, the wall is prepared so that the packer will have a clean surface, free of debris, to set against. Preferably, the method includes an additional step of jetting fluid from the downhole assembly to wash an inner surface of the object before the fishing device grips the object. In this way, the inner surface of tubing is cleaned of debris so that a spear can engage the tubing more effectively.

Preferably, step (c) is achieved as the fishing device is a spear, a grapple or an overshot.

The method may include the additional steps, between steps (f) and (g), of raising the work string to move the downhole pulling tool until movement is prevented as the object remains stuck; re-anchoring the downhole assembly to the wall of the open hole section; operating the downhole pulling tool to pull the object; and releasing the downhole assembly from the wall of the open hole section. In this way, the downhole pulling tool can be used again on a single trip to sequentially pull the object to obtain a gradual release of the object. In this way, cut sections of tubular which have packers located thereon can be removed from the wellbore. Additionally, if the object sticks at any point as its being POOH, these additional steps can be used to free it so that it can be removed.

The method may include the additional steps, between steps (f) and (g), of raising the work string to move the downhole pulling tool until movement is prevented as the object is stuck; re-anchoring the downhole assembly to a wall of outer casing located uphole of the open hole section; operating the downhole pulling tool to pull the object; and releasing the downhole assembly from the wall of outer casing. In this way, the downhole pulling tool can additionally be used to free the object if it sticks when the downhole pulling tool is no longer in the open section. This may be needed when pulling a length of cut section of tubular around the heel or other deviation on the well.

The method may include the additional steps of including a cutting tool in the downhole assembly at step (a) and using the cutting tool to cut the object free from any attachment in the open hole section. When the object is a cut section of tubular, the cutting tool is used to cut the tubular to form the cut section of tubular. The step of cutting the tubular may be performed between steps (b) and (c). Alternatively, the step of cutting the tubular may be performed between steps (c) and (d). In this way fishing device can be used to stabilise the cutting tool during the cut and place the tubular in tension for the cut. Optionally, the step of cutting the tubular may be performed between steps (d) and (e). In this way the work string is anchored to the wellbore to assist in stabilising the structure during the cut and place the tubular in tension for the cut.

According to a second aspect of the present invention there is provided apparatus to move an object from an open hole section of a wellbore, comprising a string for running into the well, the string being arranged to carry a fluid in a throughbore thereof and including a downhole assembly, the downhole assembly comprising:

a downhole pulling tool, the downhole pulling tool comprising an open hole anchor including an elastomeric anchor element for axially fixing the downhole assembly to a borehole wall of an open section of the wellbore and an inner mandrel axially moveable relative to the anchor in response to the fluid in the throughbore;

a fishing device connected to the inner mandrel for engaging the object; wherein an increase in fluid pressure in the throughbore operates the downhole pulling tool to anchor the downhole assembly to the borehole wall, raise the inner mandrel relative to the open hole anchor and pull the object.

In this way, the downhole pulling tool can operate as a hydraulic jack in an open hole section of a wellbore to move an object. In an embodiment, the downhole pulling tool can operate as a hydraulic jack in an open hole section of a wellbore to pull a cut section of tubular.

Preferably, the open hole anchor is re-settable. In this way, the downhole pulling tool can be released, moved and re-anchored in the open hole section to operate multiple times on a single trip in the wellbore while being retrievable. Preferably, the anchor comprises an inflatable packer element. More preferably, the packer element is inflated by the fluid in the throughbore. As the packer element does not have to create a seal and does not have to remain in the well, a rubber inflatable sealing element can be used which provides sufficient change in diameter to span the annulus between the work string and the borehole wall. Alternatively or additionally, the anchor comprises at least one gripping element to engage the borehole wall in the open hole section. The gripping element may be a slip in a slip assembly, however sufficient travel is required to move the gripping surface of the element across the annulus between the tool body and borehole wall.

Preferably, the downhole pulling tool includes a housing supported in the well by the string and enclosing a plurality of axially stacked pistons generating a cumulative axial force, each of the plurality of pistons axially movable in response to the fluid increase in the throughbore; and wherein movement of the pistons also moves the inner mandrel.

Preferably, the downhole pulling tool is configured for a grip force in anchoring the pulling tool to the wall of the open hole section to be greater than a pull force of the inner mandrel on the object. The grip force of the packer used to anchor the assembly and the pull force of the downhole assembly are both proportional to the fluid pressure applied. By configuring the pulling tool such that the packer grip force is always higher than the mandrel pull force, the downhole pulling tool cannot stroke before the packer gets enough grip to prevent the packer sliding down the hole as you stroke the assembly, instead of the object moving up hole.

Preferably the fishing device comprises a spear. In this way, the spear can grip an inner surface of a tubular object such as a cut section of tubular. Alternatively, the fishing device may be an overshot. In this way, the overshot encompasses at least part of the object and grips it. An overshot can grip smaller diameter tubing in which a spear may not fit and/or provide sufficient gripping area. A grapple or an anchor may also be used.

In an embodiment, the spear comprises: a sliding assembly mounted on the inner mandrel; at least one gripper for gripping onto an inner wall of a cut section of tubular, the gripper being coupled to the sliding assembly; the sliding assembly being operable for moving the gripper between a first position in which the gripper is arranged to grip onto the inner wall of the cut section of tubular in at least one gripping region of the cut section of tubular and a second position in which the gripper is held away from the inner wall; and a switcher which, when advanced into the cut section of tubular, locks the sliding assembly to the inner mandrel with the gripper in the second position; and, when the casing spear is pulled upward out of the cut section of tubular and the switcher exits the end of the cut section of tubular, automatically allows engagement of the cut section of tubular by the gripper in the first position. In this way, the cut section of tubular is automatically gripped into engagement with the spear when the spear is at the top of the cut section of tubular. Preferably the spear is the FRM Spear supplied by Ardyne AS.

Preferably, the downhole assembly includes a jetting tool, to jet fluid from the downhole assembly. More preferably, the jetting tool has a plurality of circumferentially arranged jetting ports on a tubular body. In this way, the wall of the open hole section can be cleaned to assist in setting the packer without requiring rotation of the work string.

Preferably, the downhole assembly includes a valve for blocking the flow of fluid through the throughbore, the valve being located between the downhole pulling tool and the spear, wherein the valve is closed by raising the downhole pulling tool relative to the spear when the spear engages the cut section of tubular and opened by setting pressure down on the downhole pulling tool. In this way, the fluid pressure can be increased in the throughbore to operate the downhole pulling tool when required. Preferably the valve is the ALO valve supplied by Ardyne AS.

The downhole assembly may further comprise a cutting tool to cut a tubular and form a cut section of tubular as the object. Preferably the cutting tool is a casing cutter as is known in the art.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Embodiments of the present invention will now be described, by way of example only, with reference to the accompanying drawings of which:

Figure 1:
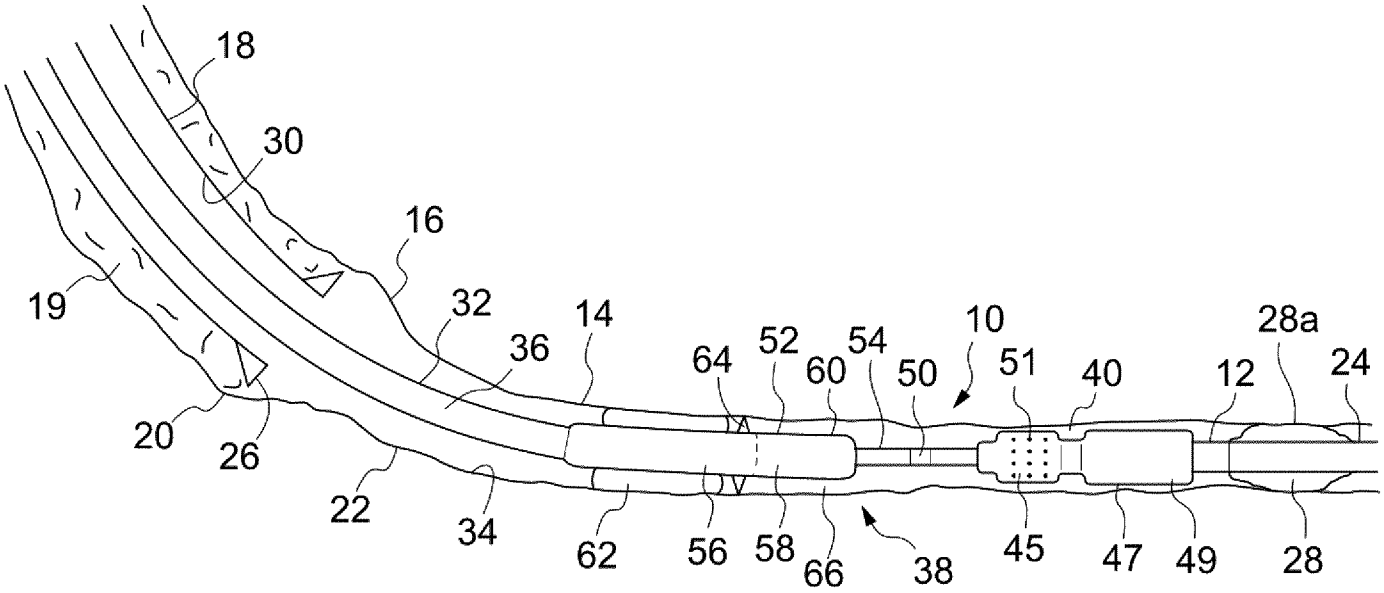
FIG. 1 is a schematic illustration of a downhole apparatus for moving an object in an open hole section of a wellbore according to an embodiment of the present invention.

Reference is initially made to FIG. 1 of the drawings which illustrates apparatus, generally indicated by reference numeral 10, for removing an object 12 from an open hole section 14 of a wellbore 16 according to an embodiment of the present invention. The apparatus 10 is located in the wellbore 16.

Wellbore 16 may be a vertical, horizontal or deviated well. In the example shown in FIG. 1, the wellbore 16 was completed using a casing string 18 which is typically run from surface (not shown) to a downhole location at the heel 20 of the wellbore 16. The casing 18 is cemented 19 in place, as is known in the art of well construction. The wellbore may then have been completed by drilling a borehole 22 and hanging a liner 24, or other tubular, from the casing shoe 26 at the heel 20. The liner 24 was held in place by packers 28 arranged along the length of the liner 24. Completion tools such as frac valves or sand screens may have been located between the packers 28. In FIG. 1, a section of the liner 24 has already been removed from the well from the heel 20 to the location of the packer 28*a*. This removal will have been completed by known casing recovery techniques. These casing recovery techniques would rely on anchoring removal apparatus to the inner wall 30 of the casing string 18. Operating any tools from a distant anchor point can cause elongation or reduced torqueing on the drill string therebetween which limits the operation of such tools. Thus, recovery of the liner 24 becomes difficult at distances further from the casing 18. This is further hampered by the packers or other equipment, together with sand and debris, which can be holding the liner 24 in place. While a lower completion of liner and packers 28 is illustrated, it will be appreciated that any arrangement in which a borehole is drilled to form an open hole section 14, where the borehole 22 wall 34 is exposed i.e. there is no cemented casing string, could be used. The object 12 is shown as the end of a liner 24, however, the object may be any object 12 located in the open hole section 14 such as other downhole components such as a valve, or an actuator of a downhole component for which movement thereof will cause an operation to be performed by the component e.g. moving a sliding sleeve to open a valve.

Apparatus 10 comprises a work string 32 which may be a drill string comprised of drill pipe sections run from surface, through which fluid can flow in a throughbore 36 thereof. A bottom hole assembly 38 is located at the end 40 of the work string 32. The bottom hole assembly 38 comprises in order from the end 40, a fishing device 47 (an overshot 49), a jetting tool 45, a valve 50 and a downhole pulling tool 52 made up of an open hole anchor 56 and an actuator system 58. Valve 50 is shown in the mandrel 54 of the pulling tool 52 but could be in the throughbore 36 anywhere below the pulling tool 52. Adjacent parts of the assembly 38 may be formed integrally on a single tool body or may be constructed separately and joined together by box and pin sections as is known in the art. Two or more parts may also be integrally formed and joined to any other part. Further parts may be included and drill pipe sections can be inserted between parts to provide a desired spaced apart relationship between the component parts. The work string 32 is typically run from a rig (not shown) via a top drive/elevator system which can raise and lower the string 32 in the wellbore 16.

The downhole pulling tool 52 can be considered as a hydraulic jack and has an open hole anchor 56 and an actuator system 58 which pulls the inner mandrel 54 up into a housing 60 of the tool 52. In a preferred embodiment the downhole pulling tool 52 is a modification of the DHPT available from Ardyne AS. It is described in U.S. Pat. No. 8,365,826, the disclosure of which is incorporated herein in its entirety by reference.

The open hole anchor 56 may be any arrangement of known open hole anchor but is preferably operated by fluid pressure in the throughbore 36. The open hole anchor 56 includes an elastomeric anchor element 62. In a preferred embodiment the elastomeric anchor element 62 is an inflatable packer which uses fluid from the throughbore 36 to fill a rubber bladder so as to expand and adhere to the borehole wall 34. By reducing the fluid pressure in the throughbore 36 the packer 62 may be deflated so as to be retrievable and re-settable in the wellbore 16. The packer 62 is used to hold the assembly 38 to the borehole wall 34 and thus does not need to create a seal. As the packers 62 use is also temporary, a rubber bladder will be suitable as the packer is not left downhole for isolation purposes.

Gripping elements 64 may also be present to assist in anchoring the assembly 38 to the borehole wall 34 of the open hole section 14 to allow the open hole packer 62 to set. While traditional slips could be used, it is likely that the gripping elements 64 will require to have a greater degree of travel to be able to span the annulus 66 and contact the borehole wall 34. As the open hole anchor 56 is to be retrievable, the gripping elements 64 need to be retractable and also preferably fluid operated. If used with a packer 62, the gripping elements 64 need not fully anchor to the borehole wall 34, but just provide sufficient hold for the packer 62 to be set.

The downhole pulling tool 52 also has an actuator system 58. This is as described in U.S. Pat. No. 8,365,826, the disclosure of which is incorporated herein by reference. The actuator system 52 has an outer housing 60 connected to the work string 32 and an inner mandrel 54 extending from the tool 52. Inside the housing 60, the mandrel 54 and housing 52 have an array of stacked pistons arranged therebetween. Fluid from the throughbore 36 enters a chamber between each pair of pistons and causes movement of the inner mandrel 54 relative to the static housing 60 (anchored to the borehole wall 34 by virtue of the anchor 56) to move the inner mandrel 54 into the housing 60 and so raise or pull any object connected to the mandrel 54. In FIG. 1, the remaining elements of the bottom hole assembly 38 are connected to the inner mandrel 54. The movement of a piston across a chamber to meet a neighbouring piston constitutes a stroke of the pulling tool 52. As there are multiple stacked pistons, the combined cross-sectional areas of the end faces when fluid pressure is applied generates a considerable lifting force via the inner mandrel 54.

The pulling tool 52 is configured to operate the open hole anchor 56 ahead of the actuator system 58. This creates the pulling action. The downhole pulling tool 52 is configured such that the grip force of the anchor is greater than the pull force on the object. The grip force of the packer used to anchor the assembly and the pull force of the downhole assembly are both proportional to the fluid pressure applied. By configuring the pulling tool such that the packer grip force is always higher than the mandrel pull force, the downhole pulling tool cannot stroke before the packer gets enough grip to prevent the packer sliding down the hole as you stroke the assembly, instead of the object moving up hole.

When fluid pressure is reduced, the anchor will unset, by virtue of the packer 62 being retrievable, and the fluid will exit the chambers so as to allow the pistons to return to their initial positions, at the opposite end of the stroke as the work string 32 is raised. The raising of the work string 32 repositions the pulling tool 52 at a location higher up in the wellbore 16. Fluid pressure in the throughbore 36 can be increased again and the process repeated to sequentially anchor the tool 52 and pull an object attached to the inner mandrel 54, any number of times, to move the object 12. Once the object is free, pulling the work string 32 should be able to pull the bottom hole assembly 38 and the object 12, in this case a cut section of liner 24, to surface for recovery.

To provide the increase in fluid pressure in the throughbore 36, a valve 50 is located below the pulling tool 52, in the mandrel 54. In FIG. 1, the valve 50 is illustrated as sitting directly below the housing 60, however the valve 68 may be positioned in any part of the mandrel below the pulling tool 52, its position being determined by other tools on the string 32. A suitable valve 50 is described in U.S. Pat. No. 8,365,826 being a ball valve operated via a drop ball. In a preferred embodiment, an ALO valve as supplied by Ardyne AS is used. The ALO valve is designed to form part of mandrel 54, and in which a valve is provided with a passage for fluid, the passage including an opening and closing mechanism. In use: a first valve portion is connected to the mandrel 54; second valve portion telescopic relative to the first valve portion is connected to a fishing device 47; in an initial position, the first valve portion and the second valve portion are held together under the force of a spring and arranged so that the opening and closing mechanism is open; pulling the mandrel 54 moves the first valve portion relative to the second valve portion thereby extending the valve to close the opening and closing mechanism. Thus the valve 50 advantageously can be cycled between open and closed positions by applying tension to the mandrel 54 on which the upper portion of the valve is attached. The ALO valve is described in U.S. Pat. No. 10,392,901, the disclosure of which is incorporated herein in its entirety by reference.

In the embodiment shown in FIG. 1, the fishing device 47 is an overshot 49. These are known and comprise a barrel arrangement which fits over the object, typically a tubular. A friction device in the overshot, usually either a basket or a spiral grapple, firmly grips the outer surface of the tubular, allowing the tubular to be pulled. The fishing device 47 may be any known device such as a grapple, anchor or spear.

Also shown in FIG. 1 is a jetting tool 45. Jetting tool 45 has a tubular body and a plurality of ports 51 through which washing fluid passed down the throughbore 36 is ejected. The ports 51 are arranged around the tool body to provide 360 degree coverage. Nozzles may be located in the ports 51 to increase the speed of the fluid, so that it crosses the annulus 66 and impacts the inner wall 34 of the open hole section 14. This allows the wall 34 to be cleared of sand and other debris which may prevent the packer 62 making a strong contact to the wall 34.

Reference is now made to FIGS. 2 to 5 which show the steps of removing an object, being a cut section of tubular, from the wellbore 16 according to an embodiment of the present invention. Like parts to those of FIG. 1 have been given the same reference numerals to aid clarity. The bottom hole assembly 38 comprises in order from the end 40, a taper mill 42, a casing cutter 44, a motor 46, a jetting tool 45, a fishing device being a spear 48, a valve 50 and a downhole pulling tool 52 made up of an open hole anchor 56 and an actuator system 58. Valve 50 is shown in the mandrel 54 of the pulling tool 52 but could be in the throughbore 36 anywhere below the pulling tool 52. The taper mill 42, casing cutter 44 and motor 46 are optional. Adjacent parts of the assembly 38 may be formed integrally on a single tool body or may be constructed separately and joined together by box and pin sections as is known in the art. Two or more parts may also be integrally formed and joined to any other part. Further parts may be included and drill pipe sections can be inserted between parts to provide a desired spaced apart relationship between the component parts. Incorporation of the casing cutter 44 and motor 46 allows the liner 24 to be cut to provide the cut section of tubular 12 on the same trip in the well as its recovery. The work string 32 is typically run from a rig (not shown) via a top drive/elevator system which can raise and lower the string 32 in the wellbore 16.

The downhole pulling tool 52 and valve 50 are as described hereinbefore. The jetting tool 45 is now located below the fishing device, spear 48, and has a narrower body so that it can locate in the liner 24.

Casing spear 48 operates as an anchor to grip the inner surface 70 of the length of liner 24. The casing spear anchors as a slip designed to ride up a wedge and by virtue of wickers or teeth on its outer surface grip and anchor to the inner surface 70 of the liner 24. The spear 48 includes a switch which allows the spear to be inserted into the liner 24 and hold the slips in a disengaged position until such time as the grip is required. At this time, the spear 48 is withdrawn from the end 72 of the liner 24 and, as the switch exits the liner 24, it automatically operates the slips which are still within the liner 24 at the upper end thereof. This provides the ideal setting position of the spear 48. In a preferred embodiment the casing spear 20 is the Flow Release Mechanism (FRM) Spear as provided by the Ardyne AS. The FRM Spear is described in U.S. Pat. No. 10,907,432, the disclosure of which is incorporated herein in its entirety by reference. The casing spear 48 is attached to the mandrel 54 below the valve 68 via a standard complimentary male and female screw threads as are known the art as a box and pin section.

Casing cutter 44 is a standard fluid pressure operated casing cutter. These casing cutters have a number of blades, typically three, which are held inside the body of the cutting mechanism as it is run in the wellbore 16. When cutting is required, fluid is pumped down the throughbore 36 of the string 32 from surface through the bottom hole assembly 38 and when sufficient fluid pressure is reached in the cutting mechanism, pistons are displaced which extend the pivoted blades outwards from the body to contact the inner wall 70 of the liner 24. By rotating the cutter mechanism by use of the downhole motor 46 located above the casing cutter 44, the blades will cut the liner 24 and produce a section of cut tubular 12. Downhole motor 46 is a positive displacement motor configured to convert hydraulic force of a pumped fluid through the work string 32 into a mechanical force to rotate the cutting mechanism.

At the end 40 of the work string 32 and bottom hole assembly 38 is a taper mill 42. The taper mill 42 has a pilot and an abrasive surface. It is rotated in use. Taper mill 42 will clear material in the open hole section 14 and bore through any material within the liner 24 as the bottom hole assembly 38 is run-in.

Figure 2:
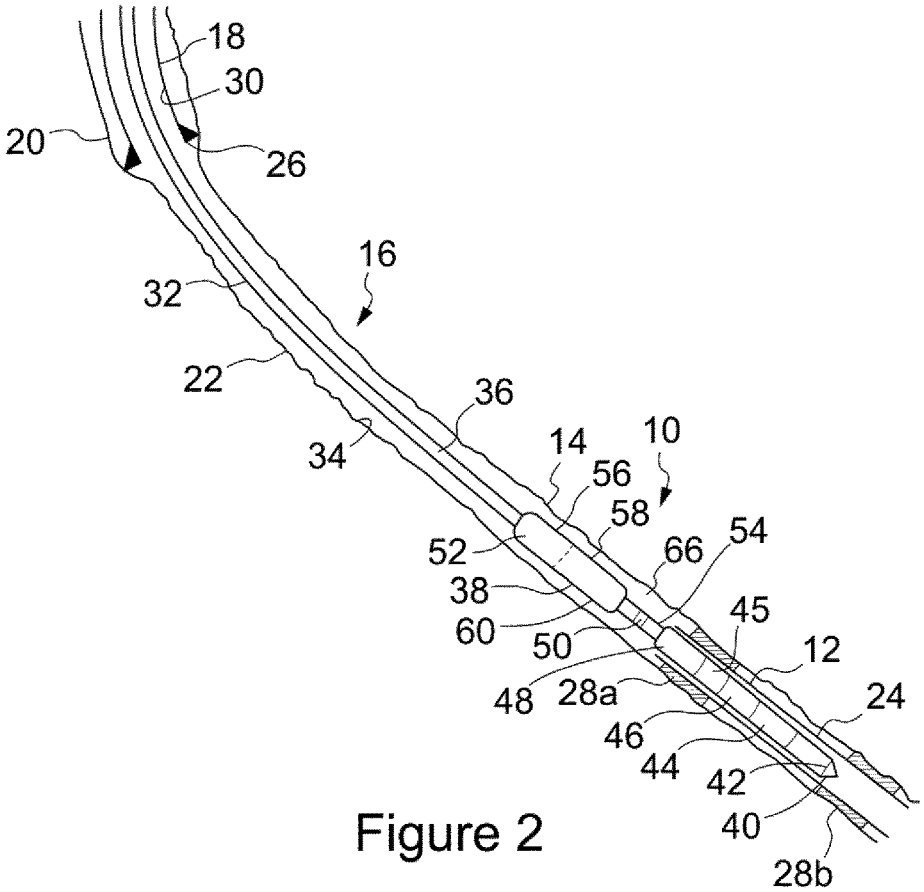
FIG. 2 is a schematic illustration of a wellbore with an open hole section in which tubular is to be retrieved using apparatus according to an embodiment of the present invention.

FIG. 2 shows the bottom hole assembly 38 has been lowered into the liner 24 on the work string 32. The bottom hole assembly 38 is lowered into the open hole section 14 after passing through the cased section 18. As the assembly 38 is run in, fluid will be circulated through the bore 36 and the assembly 38 and circulated up the annulus 66 to surface. The taper mill 42 clears a route through any material in the path and enters the end 72 of the liner 24. In this configuration, fluid pressure through the bottom hole assembly 38 is kept sufficiently low so that the pulling tool 52 and casing cutter 44 are not actuated. The jetting tool 45 is operated at locations where the packer 62 is to be set so as to clean the inner wall 34 of the borehole 22. The jetting tool 45 may also operate as the bottom hole assembly 38 enters the liner 24. In this way the inner surface of the liner 24 is cleaned in preparation to be gripped by the spear 48.

Figure 3:
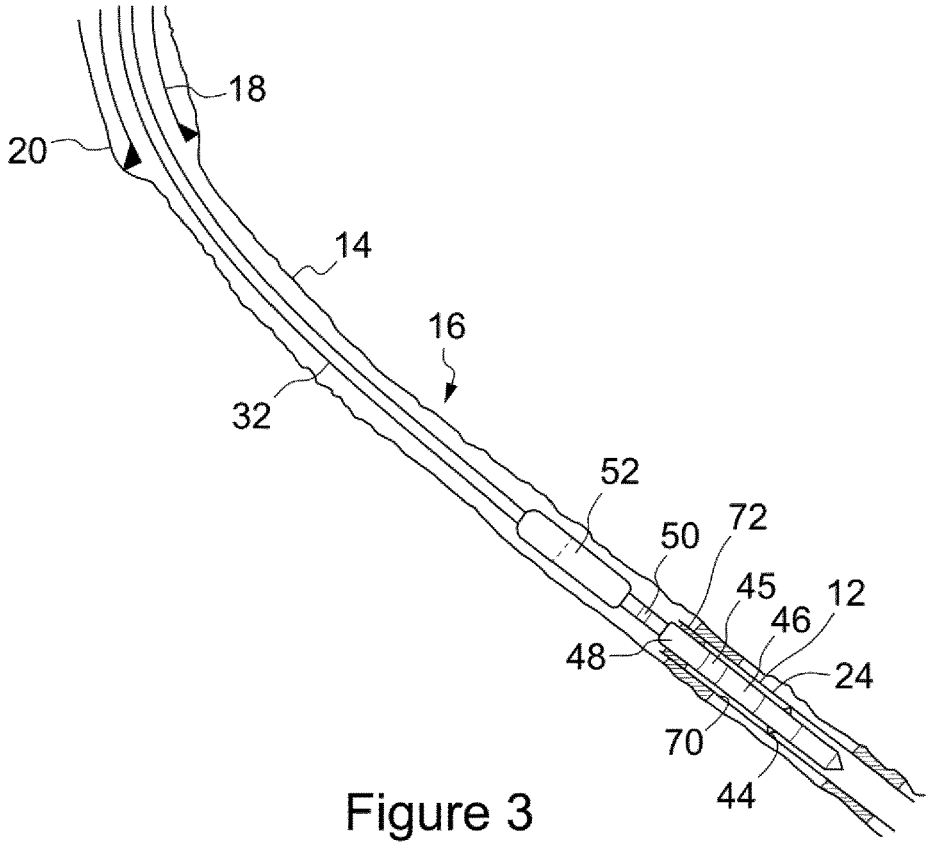
FIG. 3 is the arrangement of FIG. 2 now showing the spear engaged and the tubular being cut according to an embodiment of the present invention.

FIG. 3 shows the spear 48 now engaged to grip the inner surface 70 at the top of the liner 24. Weight is set down on the liner 24 so as to keep the valve 50 open to allow fluid flow to the casing cutter 48. Fluid pressure is increased sufficiently to operate the motor 46 and the casing cutter 48 to cut the liner 24 at a desired location. The pressure level is not sufficient to actuate the pulling tool 52. By engaging the spear 48 the liner 24 can be held partially in tension when the cut is made. A cut section of tubular 12 is now formed. This step is optional and may be performed on a separate trip into the well. The length of the cut section 12 is determined from the lengths which has previously been removed and is based on the tools and other matter surrounding the liner 24 which will cause it to stick in the wellbore 16 and prevent its easy removal.

Figure 4:
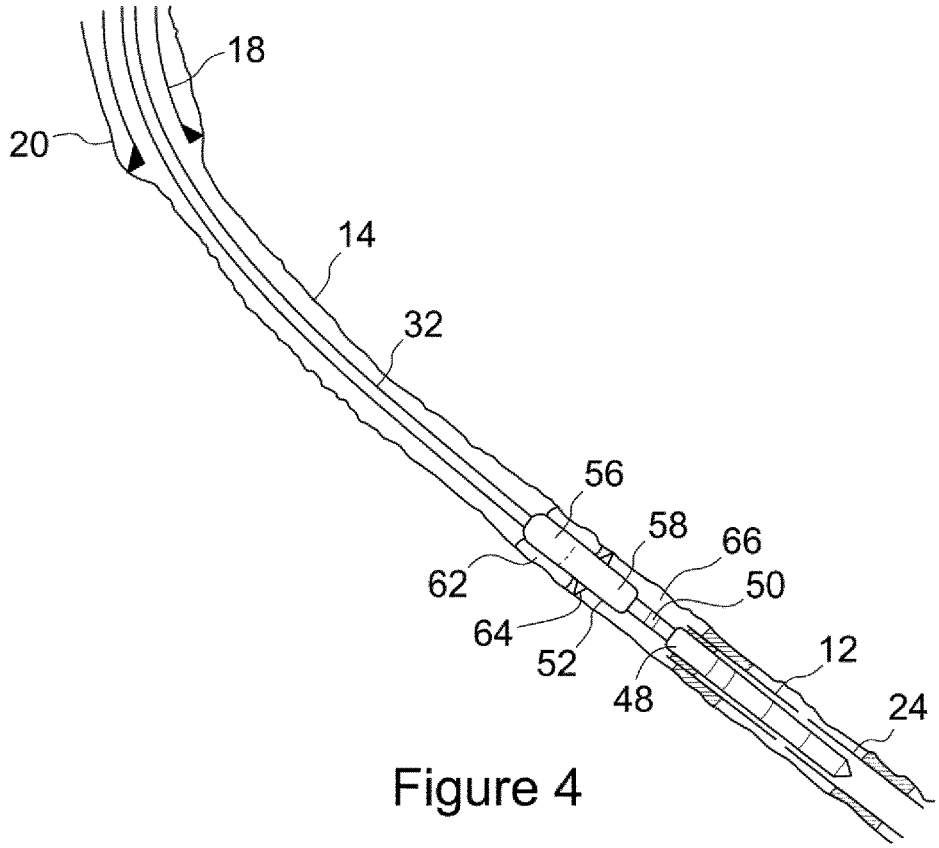
FIG. 4 is the arrangement of FIG. 2 now showing the spear engaged and the downhole assembly anchored to the borehole wall of the open hole section according to an embodiment of the present invention.

Once the cut is made, the work string 32 is raised to initially determine if the cut section of tubular 12 is free. This is unlikely and further raising will now extend the mandrel 54 to place the pulling tool 52 at the end of its stroke. Tension will now be applied to the valve 50 and cause its closure. This closes the throughbore and pressure at the pulling tool 52 will now increase sufficiently to set the open hole anchor 56 against the borehole wall 34 at the open hole section 14 of the well bore 16. This is as illustrated in FIG. 4. The spear 48 remains anchored to the cut section of tubular 12.

With the housing 60 and work string 32 anchored to the borehole wall 34, further increase in pressure will now operate the actuator system 58. Pistons attached to the inner mandrel 54 will move, raising the inner mandrel 54 and placing a large tensile load on the cut section of tubular 12 via the spear 48. This force is multiplied by the action on the plurality of stacked pistons as described hereinbefore. The distance over which the force acts is from the open hole anchor 56 over the mandrel 54 to the connection point at the spear 48. By having the open hole anchor 56 located in the open hole section 14 close to the position of the spear 48, the entire force can be committed to raising the cut section of tubular 12 without causing elongation or torqueing of the mandrel 54.

The tensile static force on the cut section of tubular 12 should begin to release it from the wellbore 16. The downhole pulling tool 52 will stroke as the mandrel 54 is raised into the housing 60. It is likely that only a small amount of movement of the cut section of tubular 12 will be possible and the tool 52 will only have partially stroked.

At this point, the tension in the string is reduced so as to cause the valve 50 to open, reducing fluid pressure in the throughbore, which is further reduced by the stopping of pumping at surface. The open hole anchor 56 is released as fluid exits the bladder and the pulling tool 52 is now free to move. The spear 48 remains anchored to the inner surface 70 of the liner 24. The string 32 is raised, which will raise the housing 60 and position of the pulling tool 52 as the mandrel 54 extends to place the pulling tool 52 at the end of its stroke. This is shown in FIG. 5.

Figure 5:
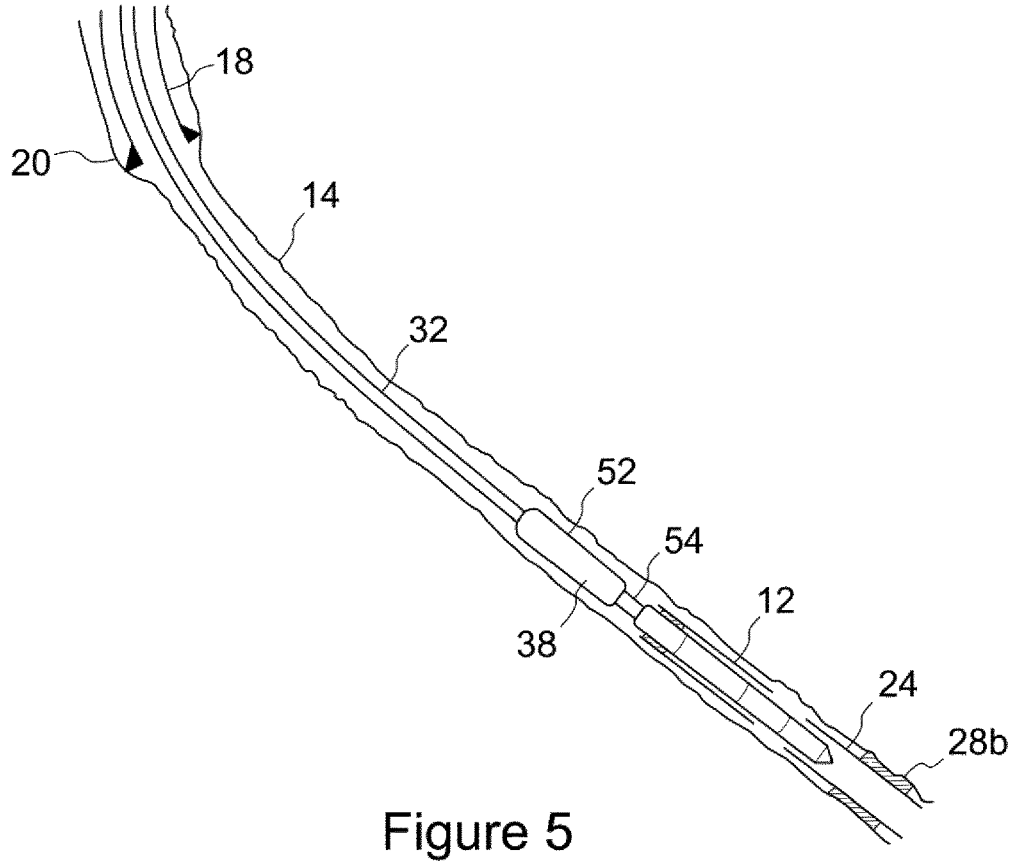
FIG. 5 is the arrangement of FIG. 2 now showing the downhole pulling tool operating to pull the cut section of tubular according to an embodiment of the present invention.
Figure 6:
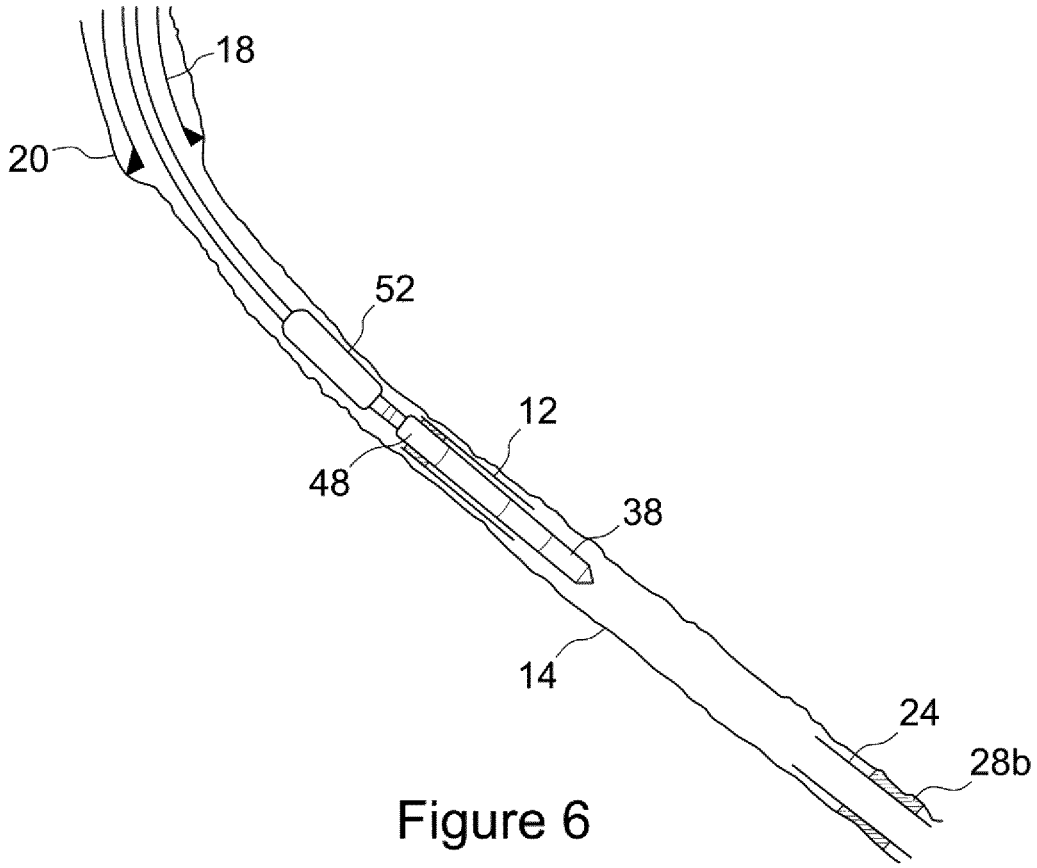
FIG. 6 is the arrangement of FIG. 2 now showing the cut section of tubular being recovered from the open hole section of the wellbore.

The steps described with reference to FIGS. 4 and 5 are repeated so as to free the cut section of tubular 12. When free, the work string 32 can be raised to recover the cut section of tubular 12. This is shown in FIG. 6. It will be appreciated that, if at any time during the removal of the cut section of tubular it were to stick in the borehole 22, the steps of applying tension to close the valve 50, set the open hole anchor 56 and operate the actuator system 58 of the pulling tool 52, as shown and described with reference to FIGS. 4 and 5, could be repeated to free the cut section of tubular 12. Additionally, if the cut section of tubular were to stick at the location of the heel 20, the open hole anchor 56 could be set against the inner wall 30 of the casing 18, so as to allow the pulling tool 52 to be operated and free the cut section of tubular 12.

While the method is described with reference to the object being a cut section of tubular, the object may be any component which is stuck in an open hole section of the wellbore. The apparatus and method can be used to move an actuator on a downhole component in the open hole section to perform an operation such as opening and/or closing a valve. Additionally, while the steps of jetting and cutting a tubular are described as occurring on the same trip into the well, these steps may be omitted or performed on separate trips into the well.

The principle advantage of the present invention is that it provides a method to move an object in an open hole section of a wellbore in which the force applied from a downhole pulling tool is applied directly to the object by anchoring the downhole pulling tool in the open hole section of the wellbore.

A further advantage of an embodiment of the present invention is that it provides a method of removing a cut section of tubular from an open hole section of a wellbore.

A yet further advantage of the present invention is that it provides apparatus to move an object in an open hole section of a wellbore in the form of a bottom hole assembly including a downhole pulling tool incorporating an open hole anchor.

A still further advantage of an embodiment of the present invention is that it provides apparatus for the removal of a cut section of tubular from an open hole section of a wellbore.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended with the invention being defined within the scope of the claims.

I claim:

1. A method to move an object in an open hole section of a wellbore, comprising the steps:

(a) providing a downhole assembly on a work string, the downhole assembly including a downhole pulling tool and a fishing device, the downhole pulling tool comprising an open hole anchor and an actuator system, the open hole anchor having an elastomeric anchor element and gripping elements;

(b) running the work string in the well bore and the downhole assembly through an outer casing of a cased section of the wellbore located uphole of the open hole section and into the open hole section;

(c) gripping the object with the fishing device;

(d) operating the gripping elements to hold the downhole assembly to a wall of the open hole section then anchoring the downhole assembly to the wall of the open hole section by contacting the elastomeric anchor element of the assembly to the wall of the open hole section;

(e) operating the downhole pulling tool to pull the object;

(f) releasing the downhole assembly from the wall of the open hole section; and (g) raising the work string to remove the downhole assembly from the wellbore.

2. The method according to claim 1 wherein at step (g) the object is removed from the wellbore on the work string.

3. The method according to claim 1 wherein the open hole anchor is an inflatable open hole packer and the elastomeric anchor element comprises a packer element of the inflatable open hole packer and step (d) comprises inflating the packer element to contact the wall of the open hole section and step (f) comprises deflating the packer element to disengage from the wall of the open hole section.

4. The method according to claim 3 wherein step (d) further comprises engaging the wall with the gripping elements of the downhole assembly and step (f) comprises releasing the gripping elements from the wall of the open hole section.

5. The method according to claim 3 wherein the open hole inflatable packer is retrievable and step (g) includes retrieving the open hole inflatable packer on the downhole assembly.

6. The method according to claim 3 wherein the open hole inflatable packer is resettable and step (f) includes resetting the open hole inflatable packer on the downhole assembly.

7. The method according to claim 1 wherein the object is a cut section of tubular and the method includes the additional steps, between steps (f) and (g), of raising the work string to move the downhole pulling tool until movement is prevented as the cut section of tubular remains stuck; resetting the open hole inflatable packer; inflating the open hole inflatable packer to re-anchor the downhole assembly to the wall of the open hole section of the wellbore; operating the downhole pulling tool to pull the cut section of tubular; and releasing the downhole assembly from the wall of the open hole section.

8. The method according to claim 1 wherein the object is a cut section of tubular and the method includes the additional steps, between steps (f) and (g), of raising the work string to move the downhole pulling tool until movement is prevented as the cut section of tubular is stuck; resetting the open hole inflatable packer; inflating the open hole inflatable packer to re-anchor the downhole assembly to a wall of the outer casing of the cased section the wellbore located uphole of the open hole section; operating the downhole pulling tool to pull the cut section of tubular; and releasing the downhole assembly from the wall of outer casing.

9. The method according to claim 1 wherein the method includes an additional step of jetting fluid from the downhole assembly to wash the wall of the open hole section against which the downhole assembly will be anchored.

10. The method according to claim 1 wherein the object is a cut section of tubular and the method includes the additional steps of including a cutting tool in the downhole assembly at step (a) and using the cutting tool to cut the tubular to form the cut section of tubular.

* * * * *